United States Patent [19]

Stiffler et al.

[11] Patent Number: 5,067,262

[45] Date of Patent: Nov. 26, 1991

[54] DIGGING TOOTH

[75] Inventors: Stephen P. Stiffler, New Enterprise; Wayne H. Beach, Roaring Spring, both of Pa.; Robert L. Frost, Sherman, Tex.

[73] Assignees: Kennametal Inc., Latrobe, Pa.; Reedrill, Inc., Sherman, Tex.

[21] Appl. No.: 562,343

[22] Filed: Aug. 3, 1990

[51] Int. Cl.[5] ..... E02F 9/28

[52] U.S. Cl. ..... 37/142 R; 37/141 R; 175/410

[58] Field of Search ..... 37/141 A, 141 R, 141 T, 37/142 R; 299/88, 79, 91; 175/410, 374, 409, 325

[56] References Cited

U.S. PATENT DOCUMENTS

| | | | |
|---|---|---|---|
| 2,968,880 | 1/1961 | Petersen | 37/142 R |
| 3,136,077 | 6/1964 | Troeppl | 37/142 R |
| 3,300,883 | 1/1967 | Troeppl et al. | 37/142 R |
| 3,426,860 | 2/1969 | Petersen | 175/392 |
| 3,693,736 | 9/1972 | Gardner | 37/142 R |
| 3,704,753 | 12/1972 | Hasforth et al. | 37/142 R X |
| 3,736,676 | 6/1973 | Sturgeon | 37/142 R |
| 3,821,993 | 7/1974 | Kniff et al. | 175/292 |
| 3,841,709 | 10/1974 | Kniff | 299/88 |
| 3,924,697 | 12/1975 | College | 175/382 |
| 4,702,525 | 10/1987 | Sollami et al. | 175/410 X |
| 4,725,098 | 2/1988 | Beach | 299/79 |
| 4,865,392 | 9/1989 | Penkunas et al. | 175/410 X |
| 4,917,196 | 4/1990 | Stiffler et al. | 175/385 |
| 4,932,723 | 6/1990 | Mills | 299/56 |

*Primary Examiner*—Dennis L. Taylor
*Assistant Examiner*—J. Russell McBee
*Attorney, Agent, or Firm*—Larry R. Meenan

[57] ABSTRACT

A digging tooth including a body portion and a plurality of hard water resistant conical inserts. The body portion includes a generally planar distal portion, a medial portion, and a bifurcated proximal portion having at least two prongs separated from each other to form a slot. The conical inserts are secured to and spaced along said distal portion and have a generally cylindrical body portion and a top portion which tapers to a point to form a tip, wherein the ratio of the diameter of the cylindrical body portion to the spacing distance between the tips of the conical inserts is between 0.50 and 0.80 and, preferably, 0.72.

11 Claims, 2 Drawing Sheets

DIGGING TOOTH

BACKGROUND OF THE INVENTION

The present invention relates to a replaceable digging tooth. More particularly, the present invention relates to a new and improved replaceable digging tooth useful in the drilling industry.

DESCRIPTION OF THE RELATED ART

Various types of teeth useful in digging equipment such as earth augers, trenching machines, or other digging tools are well known. One type of tooth useful in an earth auger which may be used for rock cutting and drilling is described in U.S. Pat. Nos. 3,924,697 and 3,821,993. The cutting tooth typically includes a conical style insert made of a hard wear resistant material mounted within a tooth body secured to auger plates or weld on tooth holders. The cutting teeth are inclined about the body of the auger in the direction of rotation of the auger. As the cutting teeth cut into a work surface, the cutting teeth rotate within the respective block mounts to maintain the sharpness of the cutting tooth insert. It will be appreciated that the conical cutting tooth insert is typically a wear resistant cemented carbide insert having a conical shape. The conical insert utilized on this type of tool is commonly between 0.3 and 0.75 inches in diameter to provide sufficient strength and allow for adequate surface contact with the work surface. It will also be appreciated that due to the size of the individual cutting teeth and block assemblies, the number of cutting teeth that may be secured to the auger is limited by the size of the cutting tooth and cutting block assemblies mounted on the auger and the distance between the various cutting teeth positioned about the body of the auger. To provide increased cutting tooth action, the tendency in the industry has been to increase the diameter of the conical style insert and decrease the number of cutting teeth mounted about the auger. Although increasing the cutting tooth size and decreasing the number of cutting teeth mounted about the auger has increased the cutting action, it has also decreased the cutting efficiency of the auger. More particularly, as the cutting teeth are brought into contact with a work surface, large areas of the work surface between the cutting teeth are not affected and thus not cut away. The nonremoval of portions of the work surface, such as a rock surface, is known as coring. Coring is recognized as causing excessive wear of the body of the rock auger tooth as well as impeding the penetration of the auger.

Yet another style of rock auger tooth is disclosed in U.S. Pat. Nos. 3,426,860; 3,300,883; 3,136,077 and 2,968,880. The teeth disclosed in U.S. Pat. Nos. 3,426,860; 3,300,883; 3,136,077 and 2,968,880 generally include a tapered distal portion which performs the digging function and a bifurcated proximal portion composed of two prongs separated from each other by a rectangular slot which extends forwardly from the proximal end of the teeth. Each tooth may include a straight transverse cutting edge or a plurality of chisel style carbide inserts having a straight transverse cutting edge. When engaged in a hard work surface such as rock, the transverse chisel style cutting edge has a tendency to grind and pulverize the surface to be cut and resist penetration into the work surface. Moreover, as disclosed in U.S. Pat. No. 3,426,860, the body of the tooth is formed of a relatively soft material in relation to the hard inserts such that the body of the tooth wears and recedes whereas the hard inserts do not wear rapidly thus shortening the useful life of the tooth body. This problem is exacerbated by the minimal gage between the tip of the chisel style carbide insert and the tooth body such that during cutting of the work surface the tooth body is exposed to the abrasive pulverized cut work surface.

To alleviate the aforementioned problems, such as preventing excessive wear of the body of the tooth and providing a more efficient cutting tooth, we have invented a replaceable digging tooth having a plurality of cutting inserts of a specific shape which possesses sufficient gage clearance to prevent excessive wear of the tooth body and provides superior cutting action.

Accordingly, it is an object of the present invention to provide a replaceable digging tooth having a plurality of conical cutting inserts.

Another object of the present invention is to provide a replaceable digging tooth having a plurality of conical cutting inserts which provide maximum rock cutting action by increased cutting pressure.

It is a further object of the present invention to provide a replaceable digging tooth having a plurality of conical cutting inserts which provide increased gage distance between the tip of each insert and the tooth body for improved cutting penetration, longer tooth body life and less cutting resistance.

Yet another object of the present invention is to provide a replaceable digging tooth having a plurality of conical cutting inserts brazed into individual insert receiving holes to allow for proper gage distance.

Another object of the present invention to provide a replaceable digging tooth having a plurality of conical cutting inserts that is simple and economical to manufacture.

SUMMARY OF THE INVENTION

Briefly according to this invention, there is provided a replaceable digging tooth that may be attached to digging equipment such as an earth auger, a trenching machine, or any other known digging tool.

The replaceable digging tooth includes a body portion and a plurality of hard wear resistant cutting inserts. The body portion includes a generally planar distal portion, a medial portion and a bifurcated proximal portion having two prongs separated from each other by a slot which extends forwardly from the proximal end of the tooth. A plurality of hard wear resistant inserts having a conical shape are secured to the generally planar distal portion to provide adequate gage clearance and effective cutting action.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
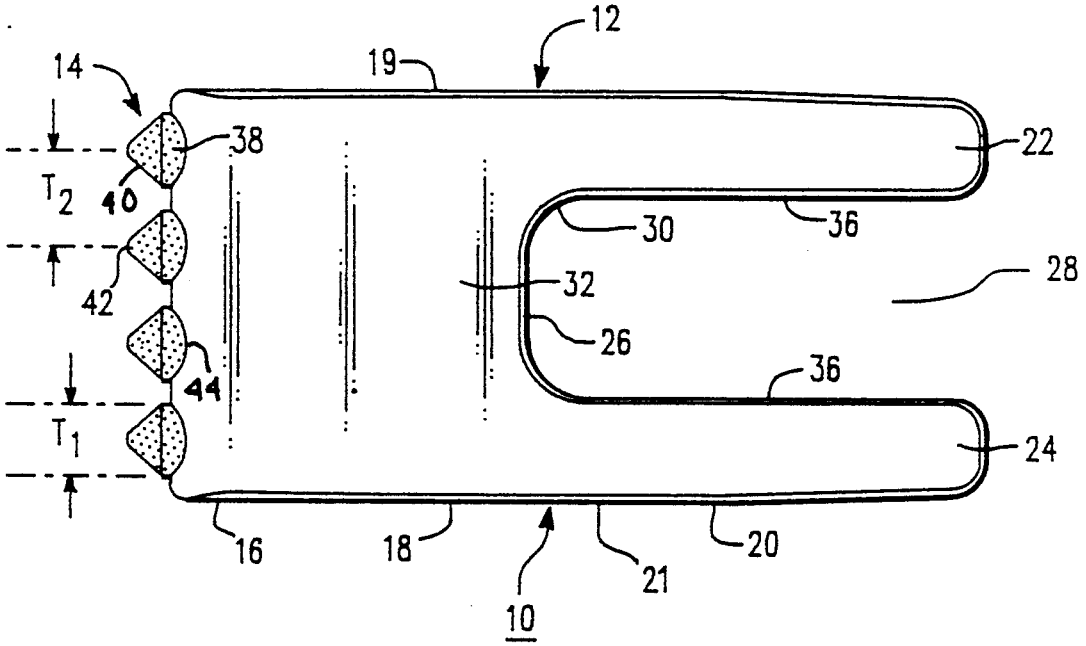
FIG. 1 is a top view of a digging tooth in accordance with the present invention.

Referring to the drawings, wherein like reference characters represent like elements, FIGS. 1–4 show a replaceable digging tooth 10 that may be attached to digging equipment such as an earth auger, a trenching machine, or any other known digging tool.

Figure 3:
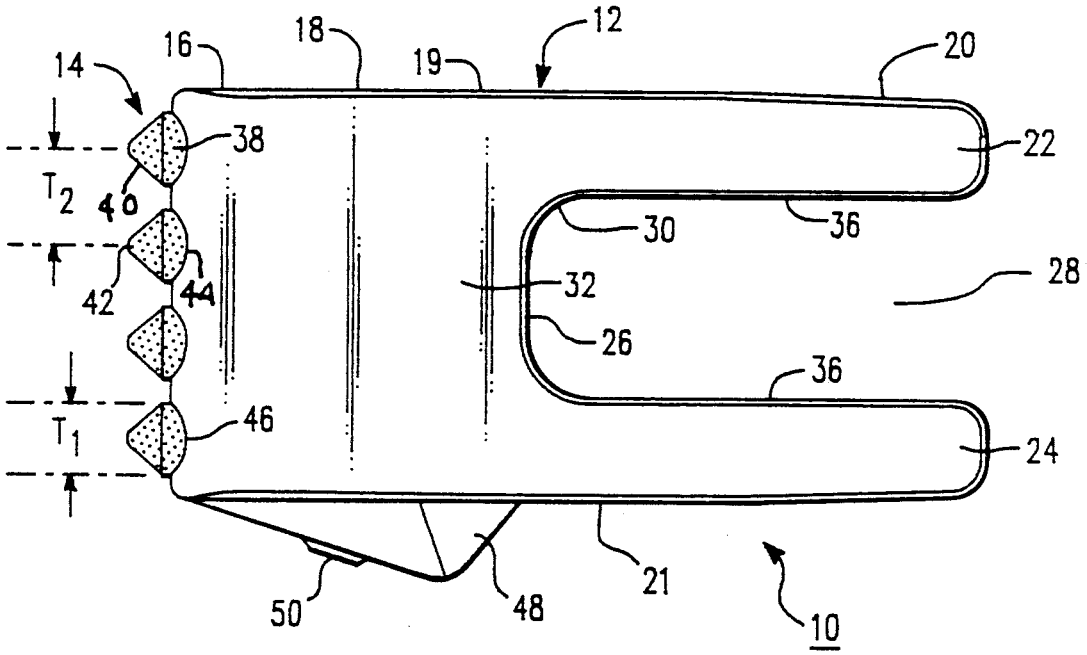
FIG. 3 is a top view of another digging tooth in accordance with the present invention.

As shown in FIGS. 1 and 3, the replaceable digging tooth 10 includes a body portion 12 and a plurality of hard wear resistant cutting inserts 14. The body portion 12 includes a generally planar distal portion 16, an enlarged medial portion 18, a bifurcated proximal portion 20 and side portions 19 and 21.

The bifurcated proximal portion 20 includes at least two prongs 22 and 24 projecting from a first side 26 of the body portion 12. The prongs 22 and 24 are separated from each other by a slot 28 which extends forwardly from the proximal portion 20 of the tooth body portion 12. The slot 28 may terminate at its forward end in a semicircular wall 30. Each prong 22 and 24 has a top 32 and a bottom 34 surface which are preferably flat and preferably parallel to one another but may also be slanted if desired. Vertical side walls 36 are formed defining the sides of the slot 28. The proximal end 20 of the tooth body portion 12 is designed to be received in a suitable complimentary matching holder (not shown) or directly fastened by any known means to the digging equipment.

Figure 2:
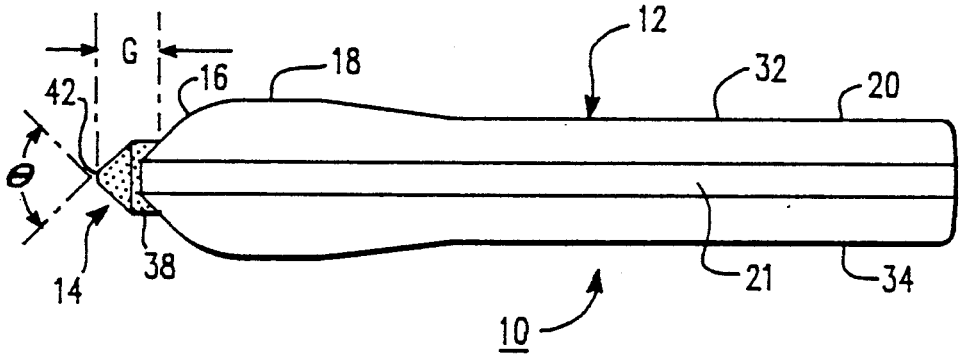
FIG. 2 is a side view of the digging tooth of FIG. 1.
Figure 4:
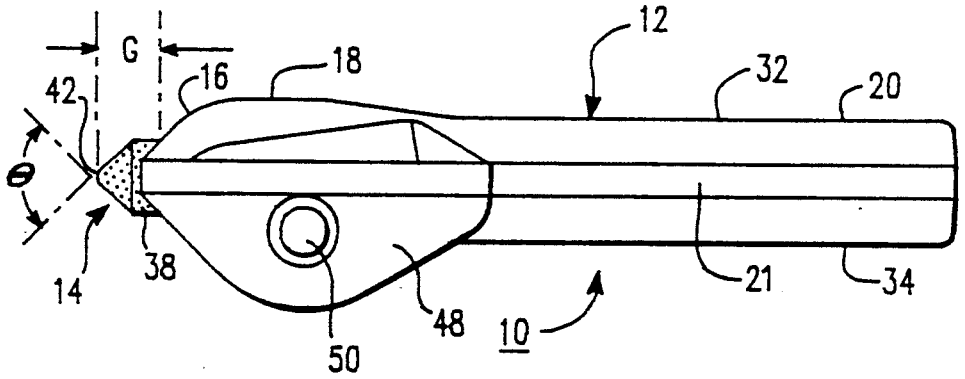
FIG. 4 is a side view of the digging tooth of FIG. 3.

As shown in FIGS. 2 and 4, integral with the proximal portion 20 and distal portion 16 of the tooth body portion is a medial portion 18 of expanded cross section. The expanded medial portion 18 provides increased durability and strength to the tooth body 12 as the digging tooth impacts upon and cuts a work surface.

Extending from the distal portion 16 in an opposing direction from the prongs 22 and 24 are a plurality of conical type inserts 14 made of a hard wear resistant material such as cemented tungsten carbide. The conical type inserts 14 as shown have a generally cylindrical body portion 38 and a top portion 40 which tapers to a point to form a tip 42. The conical type inserts 14 provide appreciably less insert surface area in contact with a work surface than a chisel type insert and thereby provide an increased cutting force per unit area of work surface based upon equal load applied by the digging tool. As shown in FIGS. 1 and 3, there are four conical type cemented tungsten carbide inserts 14 secured to the distal portion 16 of the tooth body portion 12 to provide a point contact cutting attack for more efficient cutting action and penetration. In accordance with the present invention, applicant has found that for maximum cutting efficiency and to protect the body portion 12 of the digging tooth 10, the ratio of the diameter of the cylindrical body portion 38 of a conical type insert $T_1$ to the spacing distance between the centers of two consecutive tips of the conical inserts $T_2$ must be between 0.45 and 0.80, and preferably, between 0.50 and 0.80. If $T_2$ is less than 0.50, then excessive material wear of the body portion 12 of the digging tooth 10 will result because of coring. If $T_2$ is greater than 0.80, the inserts are positioned too close together, resulting in a weakening of the strength of the body portion 12 of the digging tooth 10. Also, if the inserts are positioned too close, penetration of the digging tooth 10 and material flow during cutting action is restricted, resulting in inferior cutting penetration. In a most preferred embodiment of the present invention the ratio between the diameter of the cylindrical body portion 38 of a conical type insert $T_1$ and the spacing distance between the centers of the tips of the conical inserts $T_2$ is 0.72. To obtain a tip to tip spacing between rotating cutting teeth of a type as described in U.S. Pat. Nos. 3,924,697 and 3,821,993 which is equivalent in performance to the present invention would require a large number of cutting teeth and block mounts which would add considerable weight and cost to the digging equipment.

In accordance with the present invention, applicant has also found that the tip angle $\theta$ formed by the tapered top portion 40 of the conical insert 14 may vary from between 60 degrees and 90 degrees. To provide the most effective cutting action the tip angle $\theta$ is preferably approximately 75 degrees. The conical type inserts 14 are typically brazed into insert receiving holes 44 within the tooth body 12 using conventional brazing techniques well known in the art to provide a conical cutting tip as shown in FIGS. 1–4. The insert receiving holes 44 are formed in a second side 46 of the distal portion 16 of the tooth body 12 and are aligned along a common plane passing through the center of the tooth body. The depth of the insert receiving holes 44 formed within the tooth body portion 12 and the projection of the conical type inserts 14 from the insert receiving holes cooperatively provide a gage clearance "G" of approximately 0.34 inches between the tip 42 of the insert and the second side 46 of the distal portion 16 of the tooth body 12. It will be appreciated that this increased gage clearance "G" over prior art cutting teeth allows for improved cutting clearance for the tooth body 12 to maximize cutting penetration of the insert 14 in the material to be cut and protect the tooth body from excessive wear.

In another embodiment of the present invention as shown in FIGS. 3 and 4, to prevent excessive wear of a side portion 19 and 21 of the digging tooth 10, the digging tooth 10 may include a boss member 48 projecting laterally from a side portion of the tooth body. The opposing side portion 19 and 21 may also include a boss member or may be as shown in FIG. 2. The boss member 48 has secured within an insert receiving hole 44 a hard wear resistant material such as a cemented tungsten carbide insert 50 having a flat wear surface to resist wear of the tooth as the tooth cuts a work surface.

The invention will be further clarified by a consideration of the following examples, which are intended to be purely exemplary of the use of the invention.

EXAMPLE 1

A plurality of digging teeth each including four conical style inserts having a diameter of approximately 0.363 inch were prepared in accordance with the present invention. The digging teeth were mounted on a 30 inch diameter auger drill model 330 of a type obtained from Reedrill-Texoma Incorporated. Similarly, for comparison purposes, a plurality of digging teeth of a type described in U.S. Pat. No. 3,426,860 were also mounted in an auger drill identical to that previously described. Both auger drills were then tested in a slab of concrete of 5,000 pounds per square inch and approximately three feet thick. Three holes were drilled with each style auger drill at approximately 35–40 RPM (revolutions per minute). The auger drill having digging teeth in accordance with U.S. Pat. No. 3,426,860 drilled each hole to a depth of about 2 feet in approximately 25 minutes using 23,000–24,000 pounds of force. The auger drill having conical style inserts in accordance with the present invention drilled each hole to a depth of about 2 feet in approximately 4 minutes using approximately 18,000 pounds of force. Upon removal of the auger drill from the drilled hole and inspection of the digging teeth, no appreciable wear of the conical style inserts or the digging tooth body portion was visible. Upon removal of the auger drill from the drilled hole and inspection of the digging teeth, wear of the chisel style inserts and the digging tooth body portion was clearly visible.

EXAMPLE 2

A plurality of digging teeth each including four conical style inserts having a diameter of approximately 0.363 inch were prepared in accordance with the present invention. The digging teeth were mounted on a 30 inch diameter auger drill, model 330 of a type obtained from Reedrill-Texoma Incorporated. Similarly, for comparison purposes, a plurality of digging teeth of a type described in U.S. Pat. No. 3,426,860 were also mounted on a 30 inch diameter auger drill identical to that previously described. Both auger drills were then tested in a rock formation of hard sandstone. Holes were drilled with each style auger drill at 30–40 RPM (revolutions per minute) and 22,000 pounds force. The auger drill having conical style inserts in accordance with the present invention drilled one hole to a depth of approximately six feet in approximately 4.5 minutes and two other holes to a depth of approximately 3 feet in about 3.5 minutes. Upon removal of the auger drill from the drilled hole and inspection of the digging teeth, no appreciable wear of the conical style inserts or the digging tooth body portion was visible. The auger drill having chisel style inserts in accordance with U.S. Pat. No. 3,426,860 drilled only one hole to a depth of approximately eight inches in about 20 minutes. Upon removal of the auger drill from the drilled hole and inspection of the digging teeth, wear of the chisel style inserts and the digging tooth body portion was clearly visible.

The patents referred to herein are hereby incorporated by reference.

Having described presently preferred embodiments of the invention, it is to be understood that it may be otherwise embodied within the scope of the appended claims.

What is claimed is:

1. A replaceable digging tooth for drilling comprising:

a body portion having a generally planar distal portion, a medial portion and a bifurcated proximal portion having at least two prongs separated from each other to form a slot which extends forwardly from said proximal end of said tooth; and a plurality of conical inserts made of a hard wear resistant material secured to and spaced along said distal portion secured within a plurality of insert receiving holes formed in said distal portion, said conical inserts having a generally cylindrical body portion and a top portion which tapers to a point to form a tip to provide a point contact cutting attack for drilling.

2. The digging tooth as set forth in claim 1 wherein the ratio of the diameter of said cylindrical body portion of said conical insert to the spacing distance between the centers of two consecutive tips of said conical inserts is between 0.45 and 0.80.

3. The digging tooth as set forth in claim 1 wherein the ratio of the diameter of said cylindrical body portion of said conical insert to the spacing distance between the centers of two consecutive tips of said conical inserts is between 0.50 and 0.80.

4. The digging tooth as set forth in claim 2 wherein the angle of the taper formed by said top portion of said conical insert is between 60 degrees and 90 degrees.

5. The digging tooth as set forth in claim 4 wherein the angle of the taper formed by said top portion of said conical insert is approximately 75 degrees.

6. The digging tooth as set forth in claim 5 wherein the ratio of the diameter of said cylindrical body portion of said conical insert to the spacing distance between said centers of two consecutive tips of said conical inserts is 0.72.

7. The digging tooth as set forth in claim 6 wherein said conical insert is made of cemented tungsten carbide.

8. The digging tooth as set forth in claim 7 comprising four conical inserts secured to and spaced along said distal portion.

9. The digging tooth as set forth in claim 8 further comprising a boss member projecting laterally from said body portion.

10. The digging tooth as set forth in claim 9 further comprising an insert made of a hard wear resistant material secured within an insert receiving hole formed in said boss member.

11. The digging tooth as set forth in claim 10 wherein said insert is made of cemented tungsten carbide.

* * * * *